US008921724B2

(12) United States Patent
Young

(10) Patent No.: US 8,921,724 B2
(45) Date of Patent: Dec. 30, 2014

(54) SWITCH ASSEMBLY

(75) Inventor: Dennis R. Young, Sheffield Village, OH (US)

(73) Assignee: Delta Systems, Inc., Streetsboro, OH (US)

( * ) Notice: Subject to any disclaimer, the term of this patent is extended or adjusted under 35 U.S.C. 154(b) by 225 days.

(21) Appl. No.: 13/491,247

(22) Filed: Jun. 7, 2012

(65) Prior Publication Data

US 2012/0312673 A1 Dec. 13, 2012

Related U.S. Application Data

(60) Provisional application No. 61/494,467, filed on Jun. 8, 2011.

(51) Int. Cl.

| | |
|---|---|
| ***H01H 15/06*** | (2006.01) |
| ***H01H 13/14*** | (2006.01) |
| ***H01H 13/60*** | (2006.01) |
| *H01H 3/50* | (2006.01) |

(52) U.S. Cl.

CPC ..... *H01H 13/14* (2013.01); *H01H 13/60* (2013.01); *H01H 3/50* (2013.01)

USPC ..... 200/540; 200/345

(58) Field of Classification Search

USPC ..... 200/16 B, 520, 530–540, 341, 345

See application file for complete search history.

(56) References Cited

U.S. PATENT DOCUMENTS

| | | | | |
|---|---|---|---|---|
| 4,795,865 | A | 1/1989 | Howard | |
| 4,812,604 | A | 3/1989 | Howard | |
| 4,839,478 | A | 6/1989 | Howard | |
| 4,894,019 | A | 1/1990 | Howard | |
| 5,055,643 | A * | 10/1991 | Pardini et al. | 200/318.2 |
| 5,221,816 | A | 6/1993 | Williams | |
| 5,528,007 | A | 6/1996 | Williams et al. | |
| 5,613,598 | A | 3/1997 | Pittman et al. | |
| 5,775,482 | A | 7/1998 | Wolfe et al. | |
| 6,207,910 | B1 | 3/2001 | Harvey et al. | |
| 6,457,545 | B1 | 10/2002 | Michaud et al. | |
| 6,483,061 | B1 | 11/2002 | Harvey et al. | |
| 6,648,092 | B2 | 11/2003 | Michaud et al. | |
| 7,064,639 | B2 | 6/2006 | Harvey et al. | |
| 7,488,914 | B2 | 2/2009 | Kahnert et al. | |
| 7,777,639 | B2 | 8/2010 | Young et al. | |
| 8,513,557 | B2 * | 8/2013 | Wahrenberg | 200/520 |
| 2004/0201288 | A1 | 10/2004 | Harvey et al. | |
| 2007/0251737 | A1 | 11/2007 | Straka et al. | |
| 2008/0022971 | A1 | 1/2008 | Straka | |
| 2008/0029378 | A1 | 2/2008 | Kahnert et al. | |
| 2013/0199909 | A1 * | 8/2013 | Young | 200/345 |

* cited by examiner

*Primary Examiner* — Renee S Luebke
*Assistant Examiner* — Lheiren Mae A Caroc
(74) *Attorney, Agent, or Firm* — Tarolli, Sundheim, Covell & Tummino LLP

(57) ABSTRACT

A switch apparatus includes a housing having an interior chamber for supporting a portion of a shaft body. The shaft body has a portion extending from the housing coupled to a pull knob such that the shaft body and pull knob are selectively located from a first position to a second position. The shaft body further comprises spaced first and second legs having a securing arrangement disposed within a channel formed by the legs, the securing arrangement comprises a restricted region formed about a portion of the legs in the channel and a securing pin fixedly attached to the housing, such that the securing pin engages the restricted region when the shaft body and pull knob transition from the first position to the second position.

20 Claims, 24 Drawing Sheets

SWITCH ASSEMBLY

CROSS REFERENCES TO RELATED APPLICATIONS

The following application claims priority to U.S. Provisional Patent Application Ser. No. 61/494,467 filed Jun. 8, 2011 entitled SWITCH ASSEMBLY. The above-identified application is incorporated herein by reference in its entirety for all purposes.

TECHNICAL FIELD

The present disclosure relates to a switch assembly, and more particularly, a switch assembly used to enable power equipment such as a lawn tractor or an accessory associated with the lawn tractor.

BACKGROUND

Electrical switches using push button or plunger type switch actuators have many applications associated with power equipment, including use in automobile car doors, ignition circuits, power take-offs for lawn mowers and the like. These push buttons type switches in their applications with the power equipment identified above may be normally open, normally closed or a combination of the two. The features, design, operation, and application of push button switches are further described in U.S. Pat. No. 7,488,914 (hereinafter "the '914 patent) that issued on Feb. 10, 2009 entitled PLUNGER SWITCH, which was assigned to the assignee of the present disclosure. The '914 patent is incorporated herein by reference in its entirety.

It is possible to construct switches having more than two terminals, which combine the features of normally open and normally closed switches. For example, a "double-pole double-throw" switch behaves as a normally open switch and a normally closed switch in parallel operated by a single plunger.

When the plunger is in a normal position, one pair of normally closed terminals is bridged and a pair of normally open terminals is isolated. Alternatively, when the plunger is moved to an actuated position, the normally open terminals are bridged and the normally closed terminals are isolated. A "single-pole double-throw" switch behaves like a double-pole double-throw switch in which one of the normally open terminals is coupled to one of the normally closed terminals. When the plunger is in the normal position, a common terminal is bridged with a normally closed terminal while a normally open terminal is isolated. Alternatively, when the plunger is in the actuated position, the common terminal is bridged with the normally open terminal while the normally closed terminal is isolated.

Several proposals have been made with respect to switches in which torsion springs, leaf springs or "V"-springs are carried by plungers and used to bridge gaps between spaced terminals when the plungers are appropriately positioned. Such springs must be secured to the plungers so that the springs do not pull loose as the plungers move them into or away from engagement with the terminals. One such proposal uses a wire torsion spring having a central coil mounted on a post projecting from a surface of the plunger. An advantage of this mounting technique is that the spring may be coupled to the plunger without resort to grease to hold the parts together during assembly prior to welding. A drawback to this technique is that forming the loop which engages the post increases the cost of the spring.

U.S. Pat. No. 5,528,007 to Williams (incorporated herein by reference) concerns a plunger switch having a plunger, a retainer, a pair of terminals and an electrically-conducting wiper contact having a curved or bent middle portion defining two oppositely directed legs on either side of the middle portion. The retainer cooperates with the plunger to carry the wiper contact as the plunger moves between a normal and an actuated position. The terminals have facing contact surfaces for biased engagement with the portions of the legs exposed by the plunger and retainer to form an electrical path between the terminals when the plunger is in the actuated position. The plunger and the retainer are coupled together by arms which project from either the plunger or the retainer. The wiper contact is secured between the plunger and retainer without the need for forming a central loop in the wiper contact for engagement by the plunger.

SUMMARY

One example embodiment of the present disclosure includes a switch apparatus comprising a housing having an interior chamber for supporting a portion of a shaft body. The shaft body has a portion extending from the housing coupled to a pull knob such that the shaft body and pull knob are selectively located from a first position to a second position. The shaft body further comprises spaced first and second legs having a securing arrangement disposed within a channel formed by the legs, the securing arrangement comprises a restricted region formed about a portion of the legs in the channel and a securing pin fixedly attached to the housing, such that the securing pin engages the restricted region when the shaft body and pull knob transition from the first position to the second position.

Another example embodiment of the present disclosure comprises an electromechanical switch for operating a blade of a lawn tractor, the electromechanical switch comprises a housing having an interior chamber for supporting a portion of a shaft body. The shaft body has a portion extending from the housing coupled to a pull knob such that the shaft body and pull knob are selectively located from a first position to a second position relative to the housing. The shaft body further comprises an upper end and a lower end. The upper end has spaced first and second legs comprising a securing arrangement disposed within a channel formed by the legs. The securing arrangement comprises a narrowing region formed about a portion of the legs in the channel. The lower end comprises at least one electrical contact that changes the state of an electrical signal transmitted from the at least one contact as the shaft body and pull knob are selectively located between the first position and the second position. The electromechanical switch further comprises a cylindrical securing pin fixedly attached to the housing, such that the securing pin engages the narrowing region when the shaft body and pull knob transition between the first position and the second position.

Yet another example embodiment of the present disclosure comprises a method of actuating an electromechanical switch for operating a blade of a lawn tractor. The method comprises the steps of supporting a portion of a shaft body for movement within an interior chamber of a housing and coupling an upper end of the shaft body to a pull knob. The pull knob selectively translates the shaft body between first and second positions relative to the housing. The method also comprises forming a channel though the shaft body at the upper end defined by first and second legs. The channel is selectively moveable by an operator during use about a securing pin coupled to the housing that passes through the central channel. The method also comprises attaching at least one electrical contact to a lower end of the shaft body for changing the state of an electrical signal transmitted from the at least one contact as the shaft body moves between the first and second positions and forming a restrictive region within the channel for retaining the electromechanical switch in the selected first or second positions, The restrictive region has an opening smaller than the width of the securing pin such that the shaft body requires a force applied by the user during operation for selectively moving the securing pin through the restrictive region as the switch and shaft body passes between first and second positions.

BRIEF DESCRIPTION OF THE DRAWINGS

The foregoing and other features and advantages of the present disclosure will become apparent to one skilled in the art to which the present invention relates upon consideration of the following description of the invention with reference to the accompanying drawings, wherein like reference numerals refer to like parts unless described otherwise throughout the drawings and in which.

DETAILED DESCRIPTION

Referring now to the figures generally wherein like numbered features shown therein refer to like elements throughout unless otherwise noted. The present disclosure relates to a switch assembly, and more particularly, a switch assembly 10, 100 used to enable power equipment 12 (see FIG. 1) such as a lawn tractor or an accessory associated with the lawn tractor. In one example embodiment, the accessory includes a power-take-off ("PTO") device and/or clutch assembly. In the illustrated example embodiment of FIG. 1, the PTO and/or clutch assembly operates a cutting blade 13.

Figure 1:
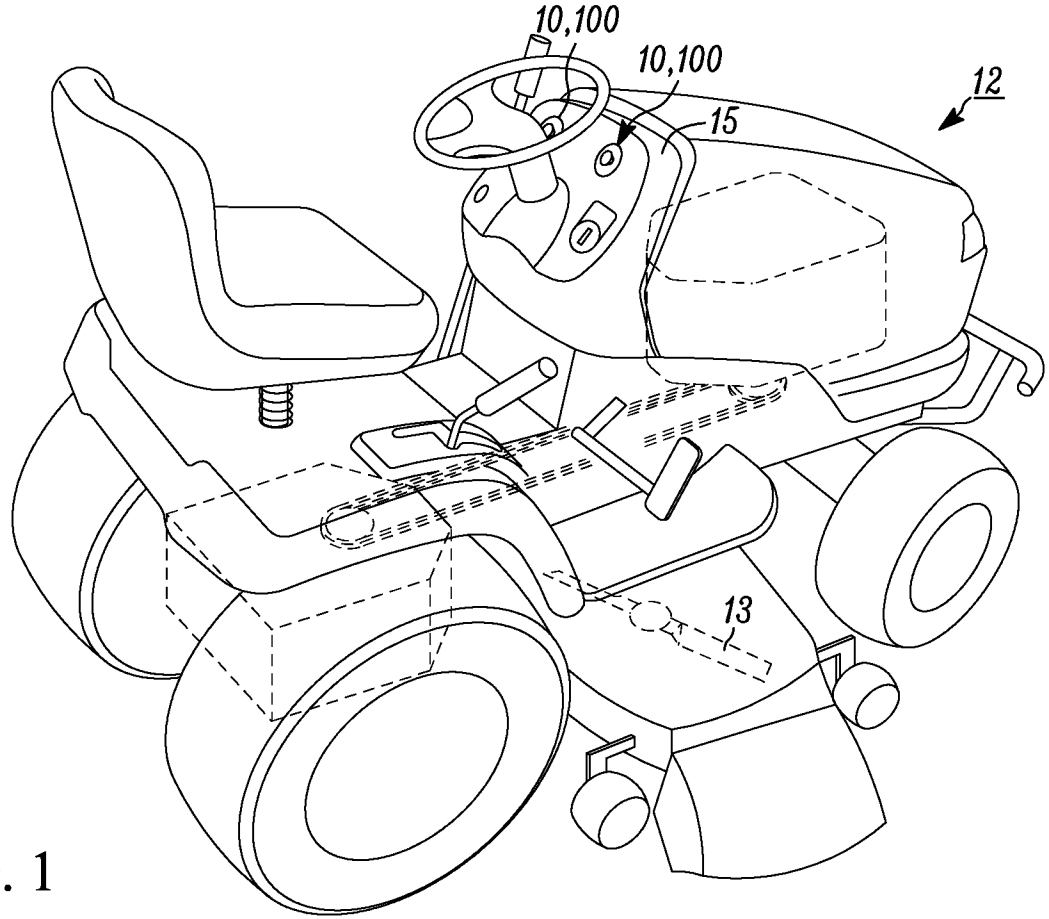
FIG. 1 is perspective view of a lawn tractor employing a switch assembly in accordance with one example embodiment of the present disclosure.

In the illustrated example embodiment of FIG. 1, the switch assembly 10, 100 is located within a dash panel 15 of the lawn tractor 12, accessible to the reach of the operator. Of course, it should be appreciated that the switch assembly 10, 100 could be located at other locations on the lawn tractor 12 without departing from the spirit and scope of the present disclosure.

Figure 2:
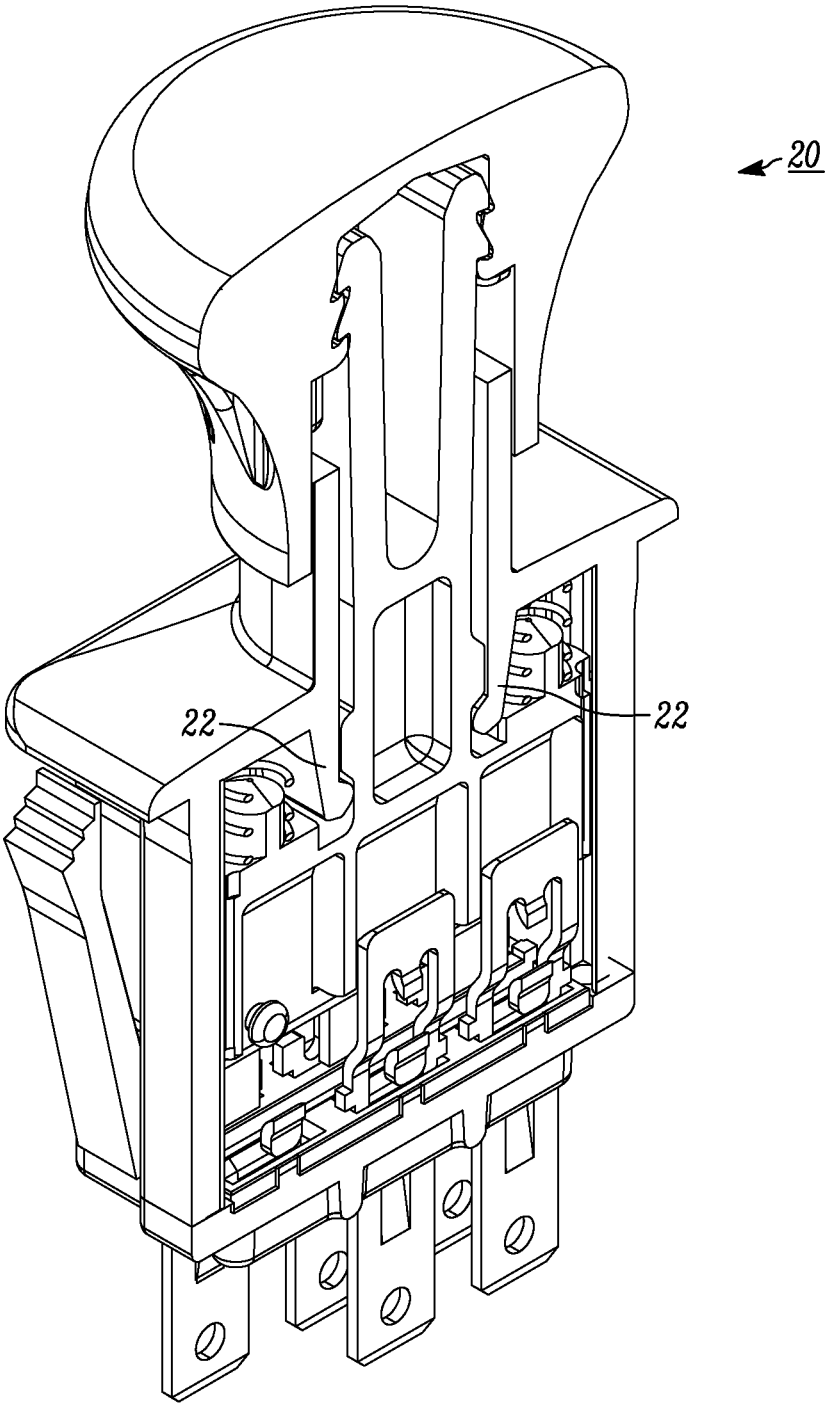
(PRIOR ART) FIG. 2
FIG. 2 is a perspective sectional view of a prior art switch arrangement in an on position.
Figure 3:
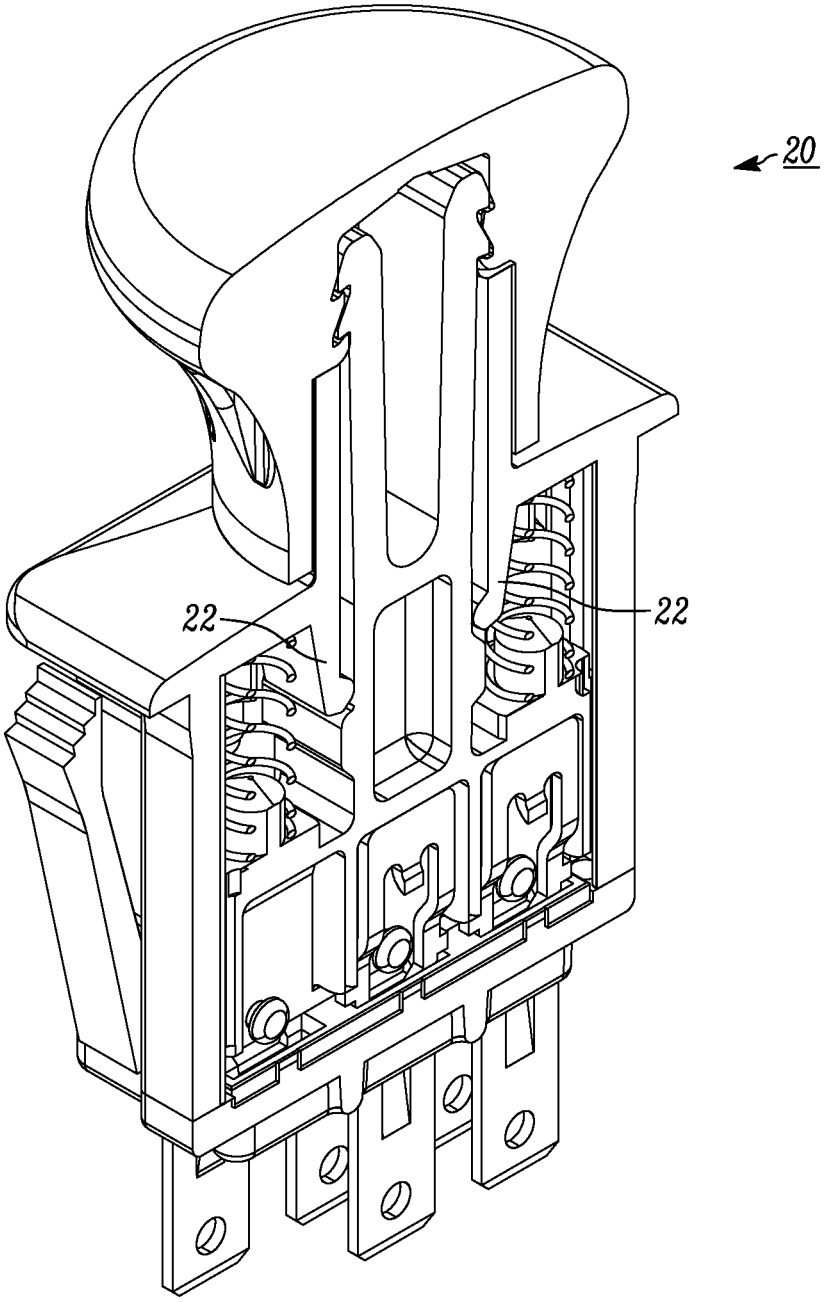
(PRIOR ART) FIG. 3
FIG. 3 is a perspective sectional view of the switch arrangement of FIG. 2 in an off position.
Figure 4:
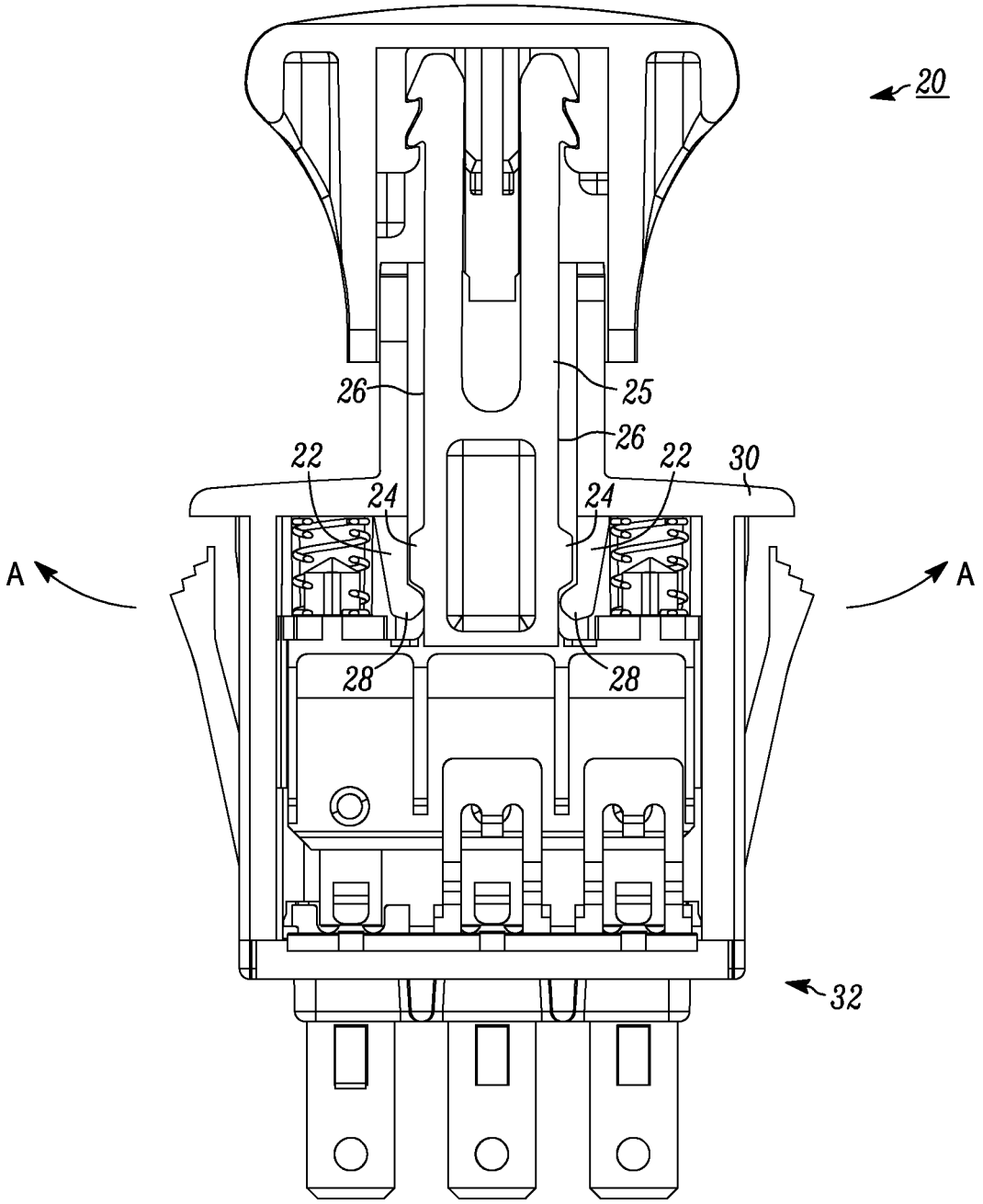
(PRIOR ART) FIG. 4
FIG. 4 is a front sectional view of the switch arrangement of FIG. 2 in an on position.

FIGS. 2-4 illustrate a prior art switch arrangement 20 in on and off positions. The switch arrangement 20 is an electromechanical switch for higher current clutch and/or PTO applications for lawn tractors. The switch arrangement 20 is a two position switch, illustrating an "ON" (enabling) or first position in FIGS. 2 and 4, and an "OFF" (disabling) or second position in FIGS. 3 and 5.

Figure 5:
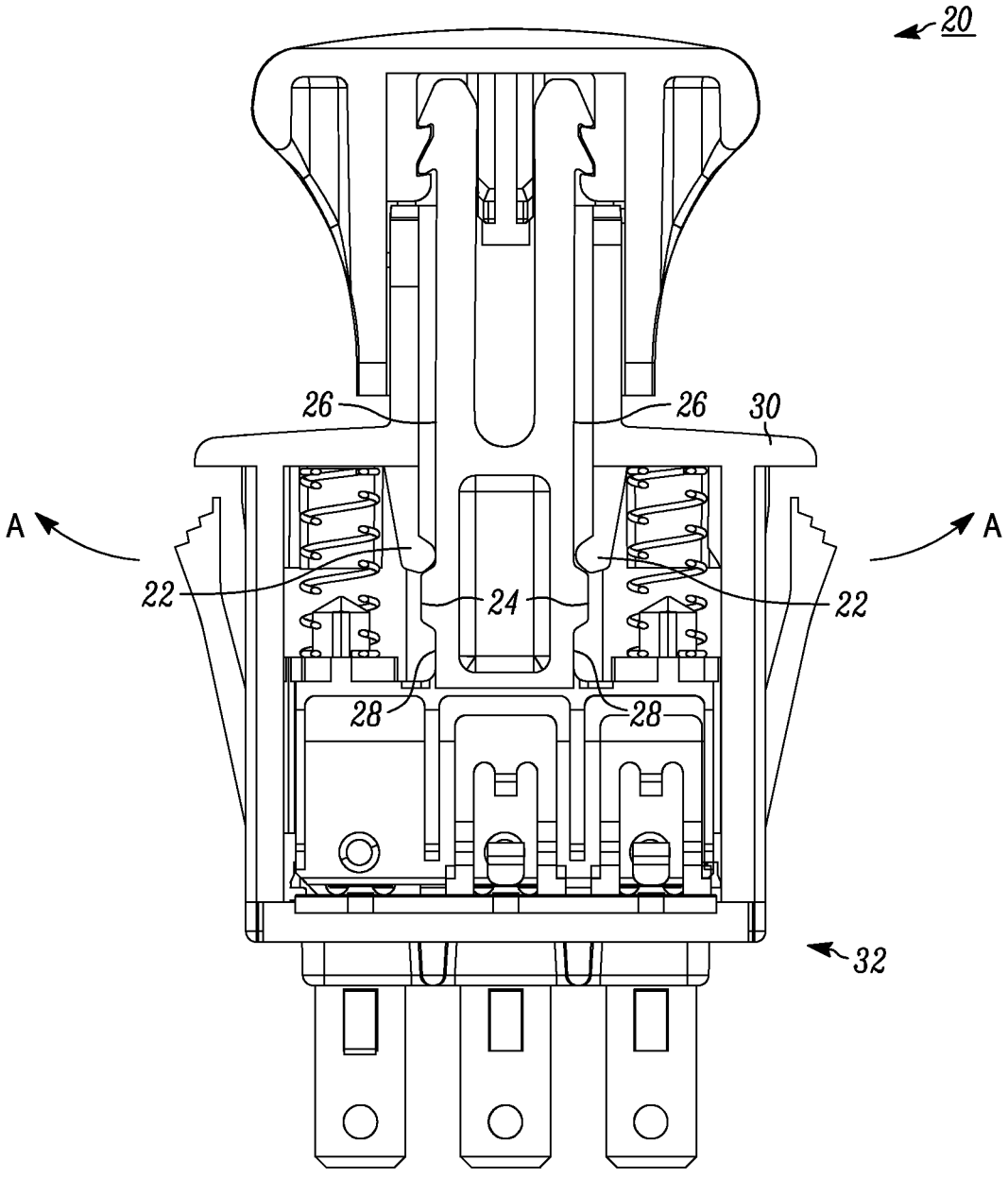
(PRIOR ART) FIG. 5
FIG. 5 is a front sectional view of the switch arrangement of FIG. 2 in an off position.
Figure 6:
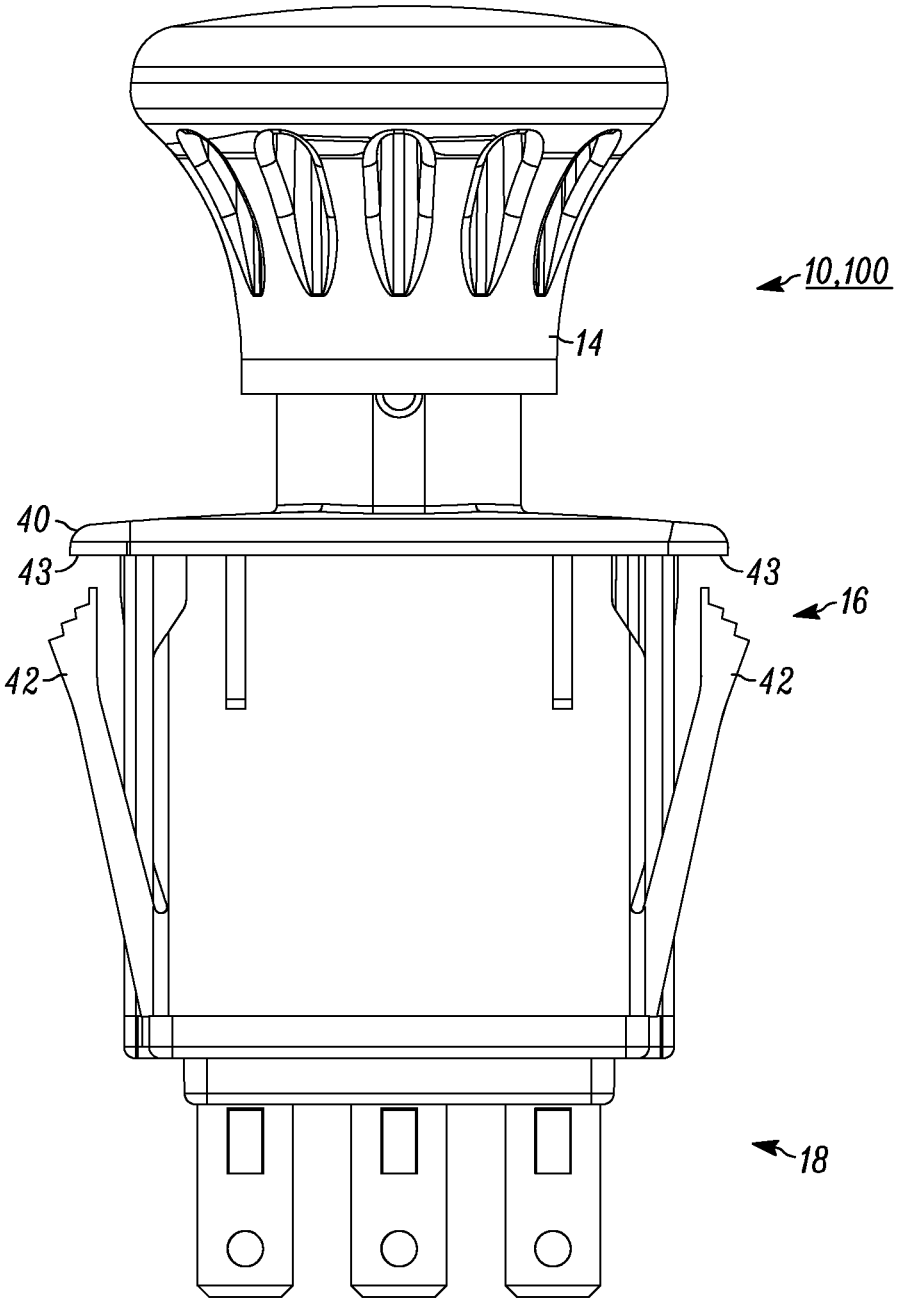
FIG. 6 is a front elevation view of a switch assembly in a first position constructed in accordance with one example embodiment of the present disclosure.
Figure 6A:
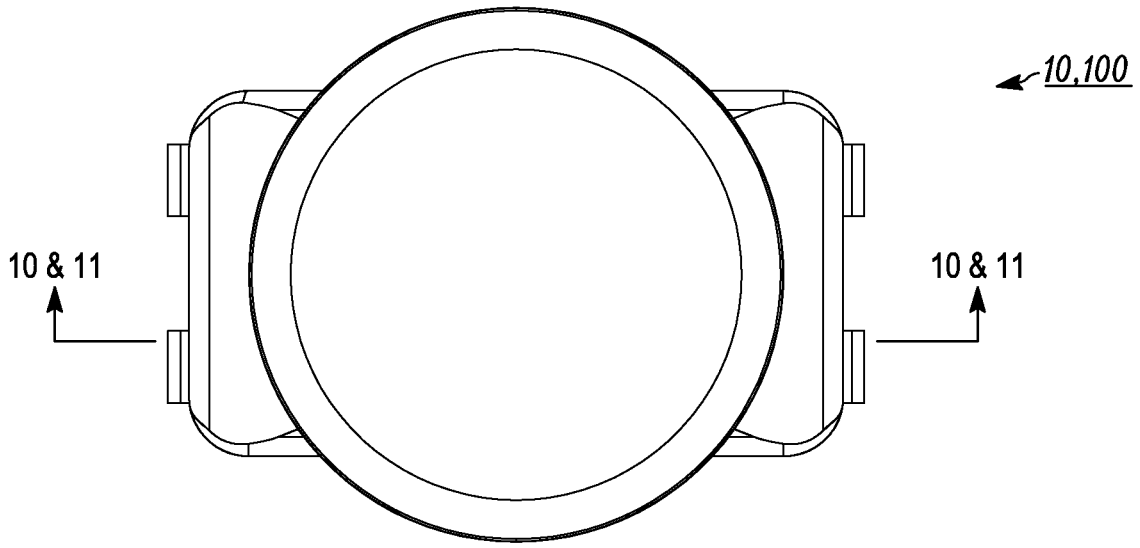
FIG. 6A is a top view of FIG. 6.
Figure 7:
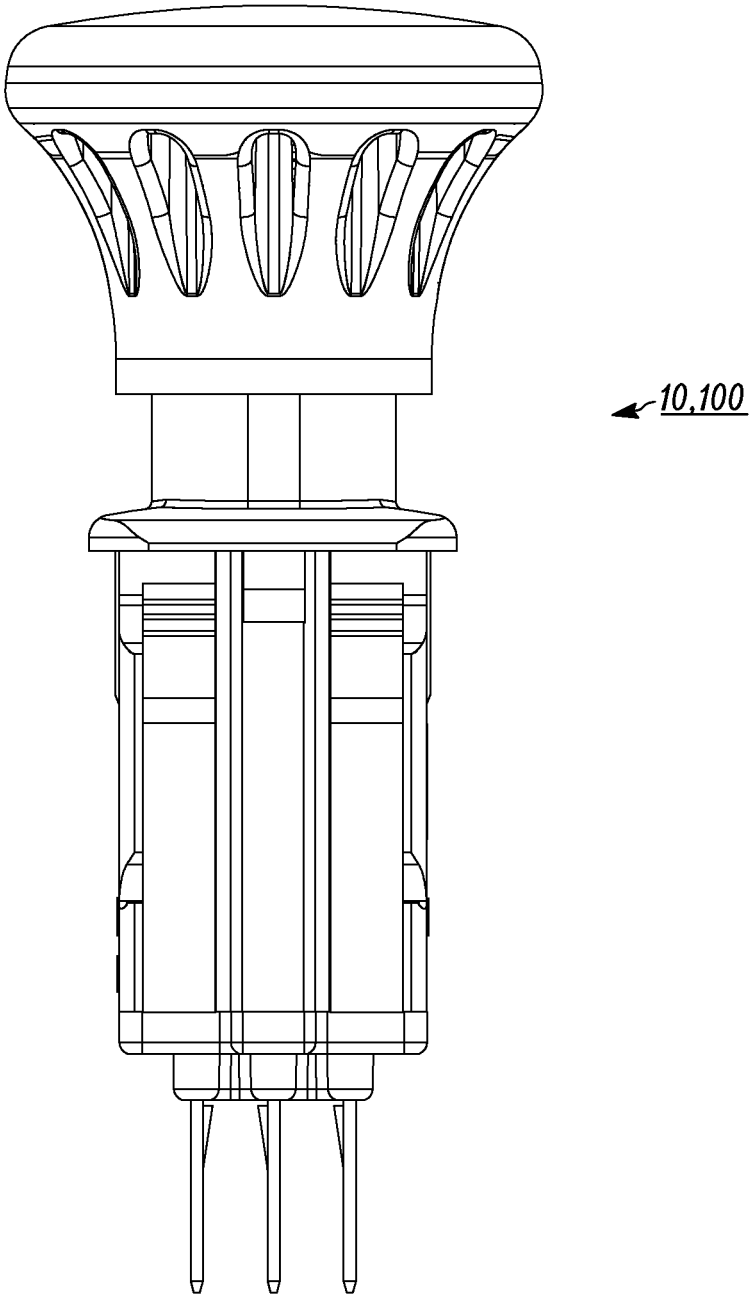
FIG. 7 is a side elevation view of FIG. 6.
Figure 8:
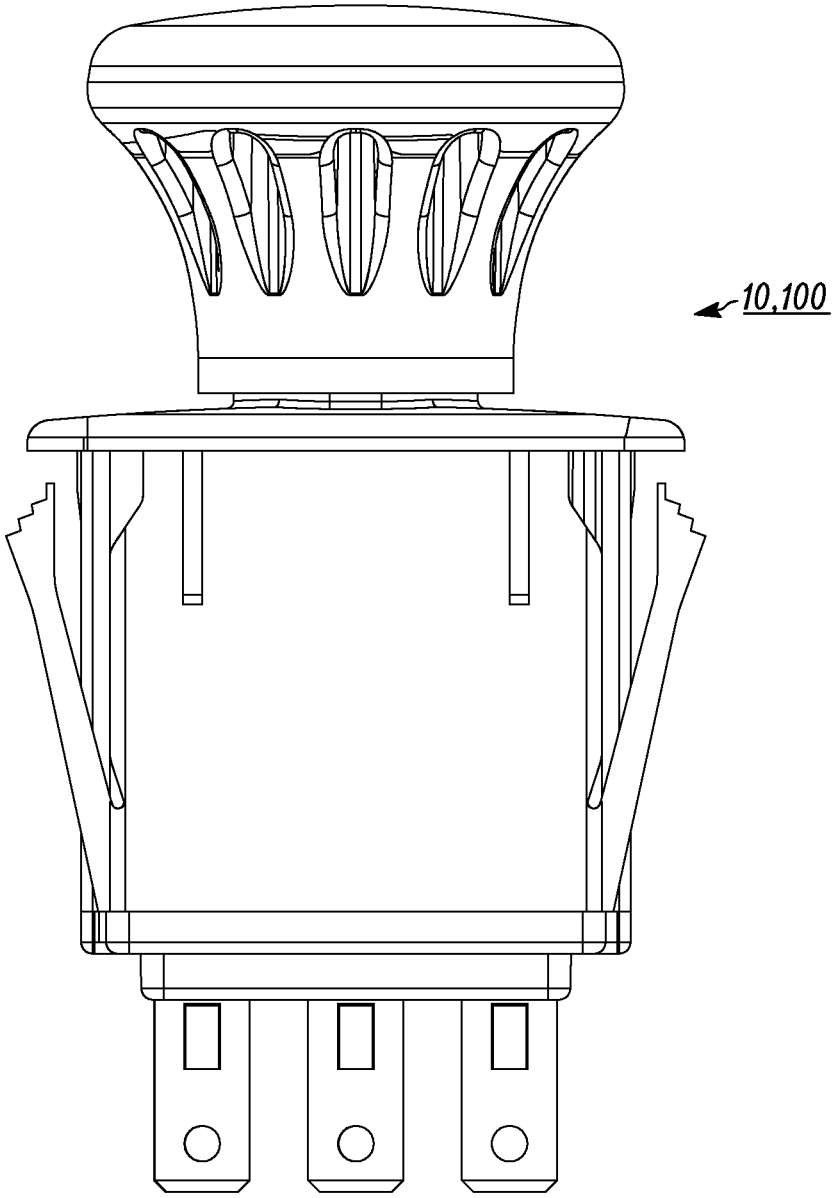
FIG. 8 is a front elevation view of a switch assembly in a second position constructed in accordance with one example embodiment of the present disclosure.
Figure 9:
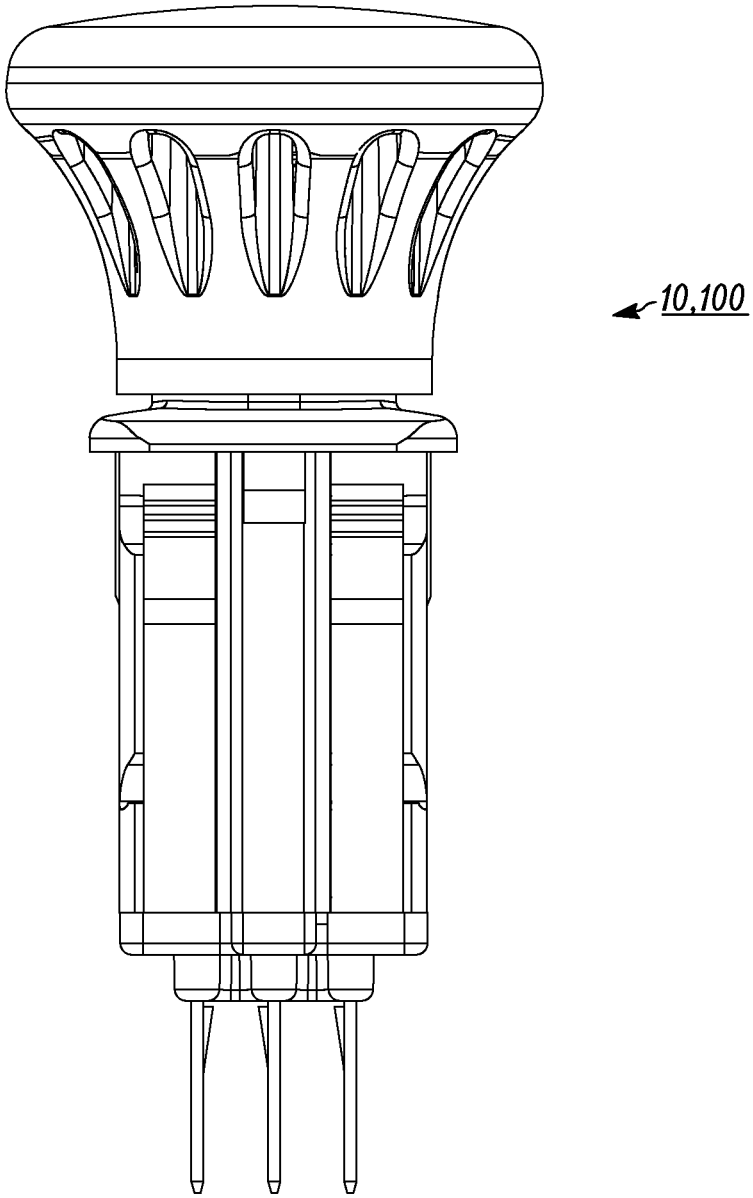
FIG. 9 is a side elevation view of FIG. 8.
Figure 10:
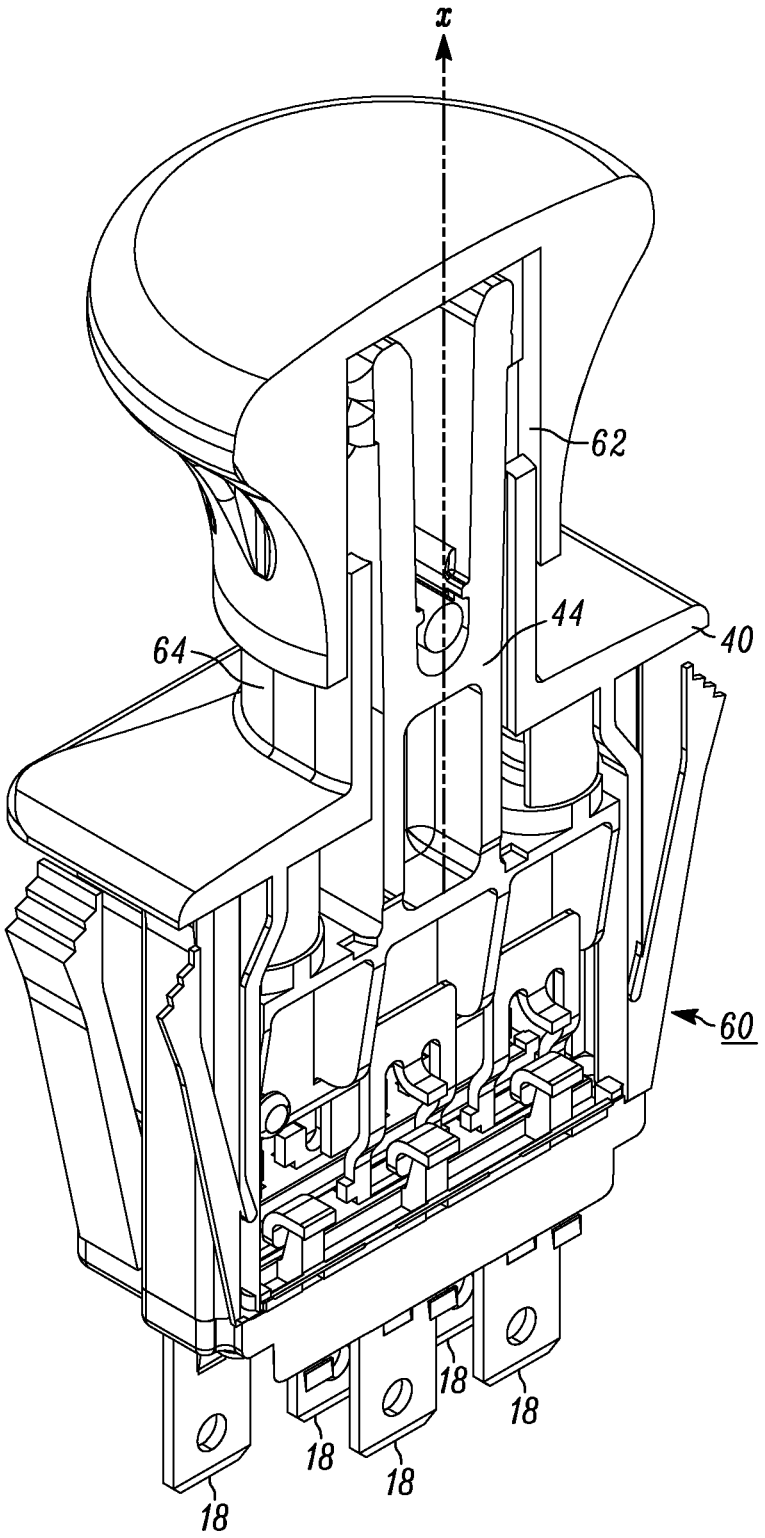
FIG. 10 is a sectional perspective view of FIG. 6A along section lines 10-10.

The switch arrangement 20 includes plastic detents 22 that are biased inward against a plastic stem 25, as the stem advances or retracts from the first position of FIG. 4 to the second position of FIG. 5. The stem 25 includes an outwardly protruding step 24 that attempts to hold the switch 20 in either the first or second positions.

When the stem 25 advances or retracts between first and second positions, the detents 22 become nested in an upper seat 26 or a lower seat 28. The detents 22 are integrally molded into a plastic housing 30 supporting switching components 32. During the advancement or retraction of the stem 25, continuous sliding contact occurs between the stem and detents 22, which are typically lubricated to reduce friction. Such movement of the stem 25 causes the housing to deflect outward at the surface when the detents 22 pass over the step 24, much like a cantilever beam as illustrated by arrows "A" in FIGS. 4 and 5.

The construction of the present disclosure minimizes the potential for switch failure that undesirably results when a switch changes in its position from an ON to OFF position voluntarily. Such failures and shortcomings are advantageously avoided by the novel features of the present disclosure further described example embodiments below and shown the accompanying figures.

Illustrated in FIGS. 6-9 are the outer details of a switch assembly 10, 100 constructed in accordance with one example embodiment of the present disclosure. The switch assembly 10, 100 comprises a knob 14, body 16, and terminals or contacts 18 that connect to a wiring harness (not shown) of the power equipment 12 or lawn tractor (see FIG. 1). The body 16 includes a housing 40 made of plastic that includes snap wings 42 for securing the switch assembly 10 into the panel 15 on the power equipment 12 (see FIG. 1) between the snap wings and under abutment 43. Further details of attaching a switch or display module to a tractor panel are further described in U.S. Pat. No. 7,777,639 entitled INDICATOR DISPLAY MODULE, which is assigned to the assignee of the present disclosure and incorporated herein by reference.

FIGS. 6-23 illustrates various example embodiments of the switch assembly 10, 100 having first and second positions (see for example first position of FIGS. 6-7, 10, 12, 17, 18, and 23; and second position of FIGS. 8-9, 16, 19 and 22). The example embodiments of switch assemblies 10, 100 are electromechanical switches for higher current clutch and/or PTO applications for power equipment 12, such as lawn tractors. Each switch assembly 10, 100 is a two position switch, illustrating the first and second positions, that in the illustrated example embodiment correspond to an "ON" (enabling first) position and an "OFF" (disabling or second) position. But it should be appreciated that the first and second positions could be reversed such that the first position is OFF and the second position is ON. Alternatively, the first and second positions could equally correspond to any combination of an actuated, a normal, or a momentary position depending on the configuration of the terminals 18 in the switch assembly 10, 100 and wiring harness coupled thereto.

The switch assembly 10 further comprises a connector assembly 50 (see FIGS. 16 and 17) formed from the knob 14 and shaft body 44. In one example embodiment, the knob 14 and shaft body 44 are made from plastic. In an alternative example embodiment, the shaft body 44 is made from a thermoplastic material with a surface lubricant impregnated into the plastic. The shaft body 44 comprises first and second legs, 45, 46, respectively, base member 47 and contact region 48. At a distal end 49 of the legs 45, 46, a plurality of barbs 51 are formed that nest in corresponding slots 52 formed within the knob 14.

The first and second legs 45, 46 are spaced by a central channel 53 that extends from the distal end 49 to a proximal end 54, contacting the shaft body 44. The central channel 53 includes an upper portion 55 and a lower portion 56 spaced by a first riser region 57 located on the first leg 45 projecting inward toward the central channel and a second riser region 58 located on the second leg 46 directly opposing the first riser region and equally projecting inward toward the central channel.

Referring now specifically to FIGS. 10-15, the shaft body 44 is positioned within an internal chamber 60 of the housing 40 (see FIG. 10) and the contact region 48 is a relatively planer with the base member 47. The contact region 48 positions a number of terminals 18 having conductive surfaces for biased engagement with selected switch contacts to form an electrical path between with terminal assembly via a wire harness (not shown).

Figure 11:
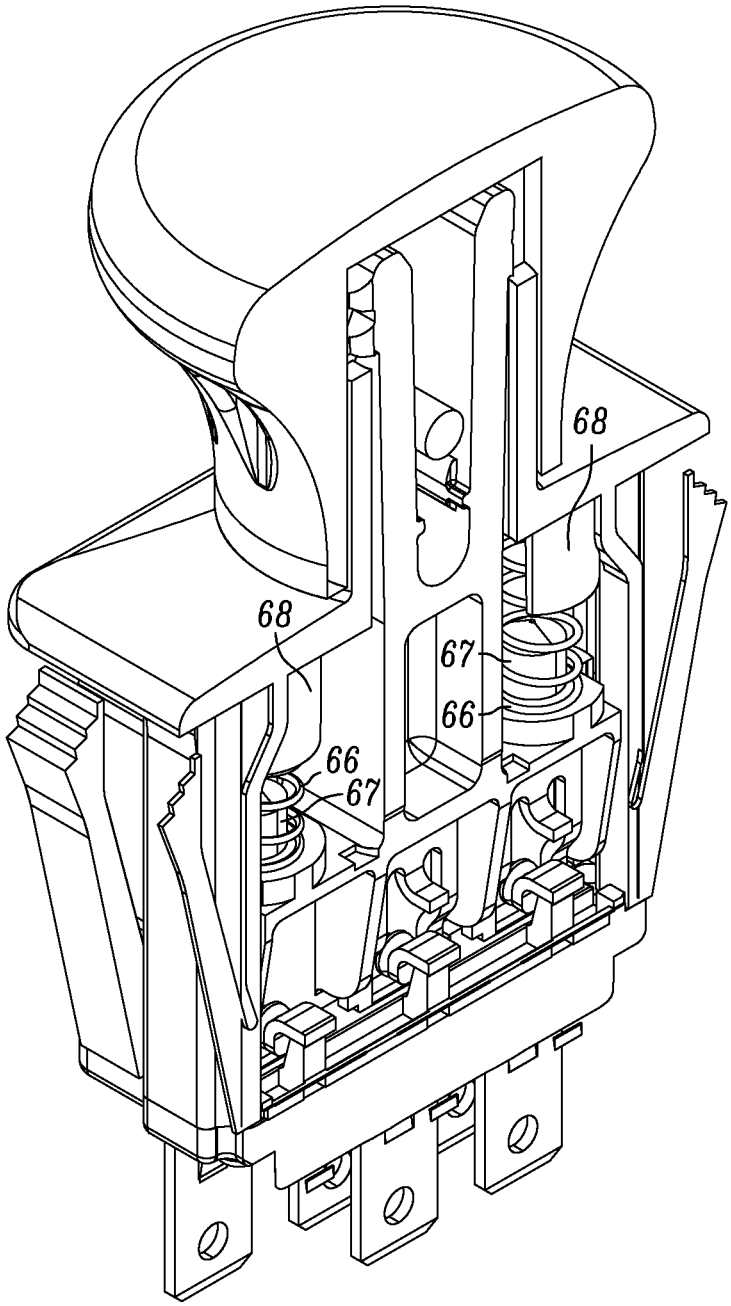
FIG. 11 is a sectional perspective view of FIG. 6A along section lines 11-11.
Figure 12:
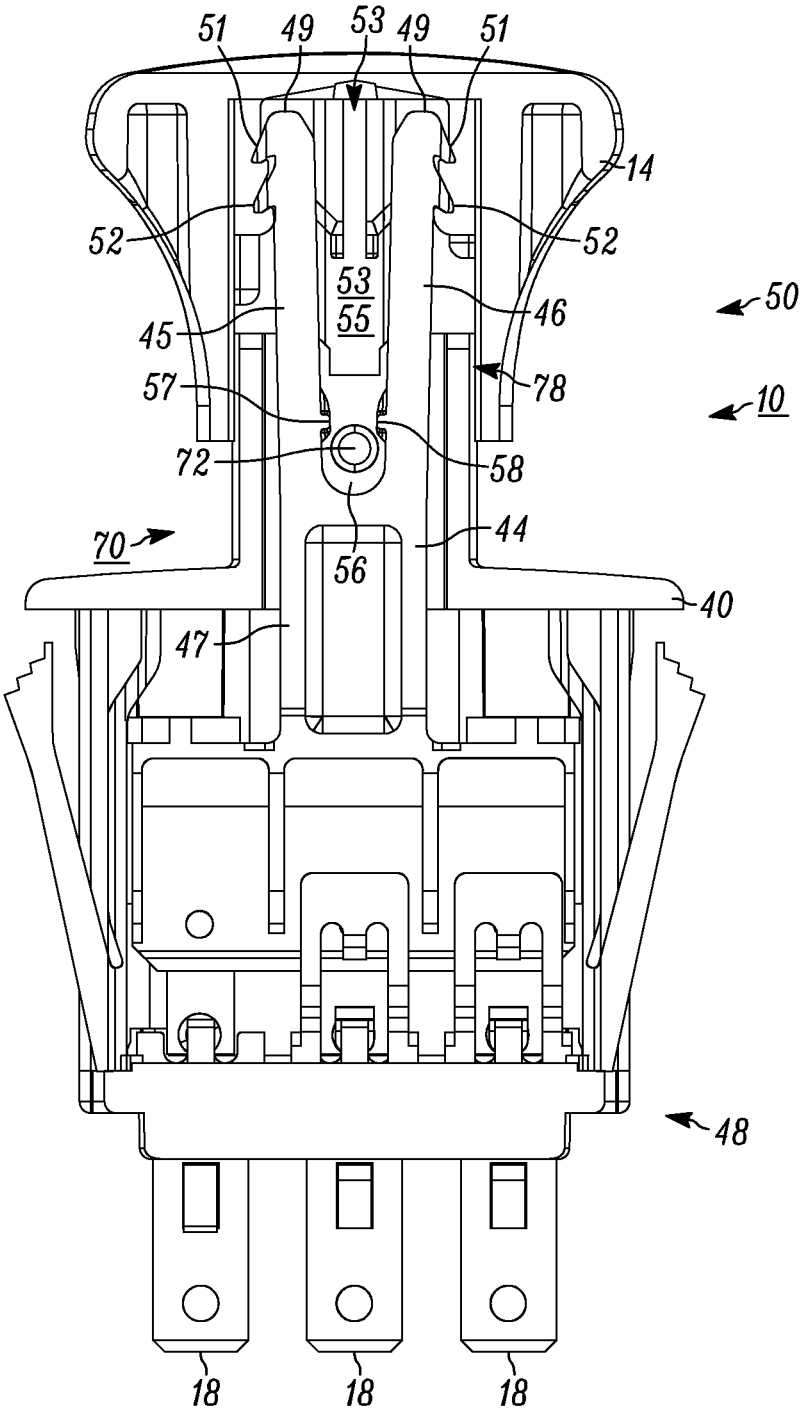
FIG. 12 is a front elevation view of FIG. 10.
Figure 13:
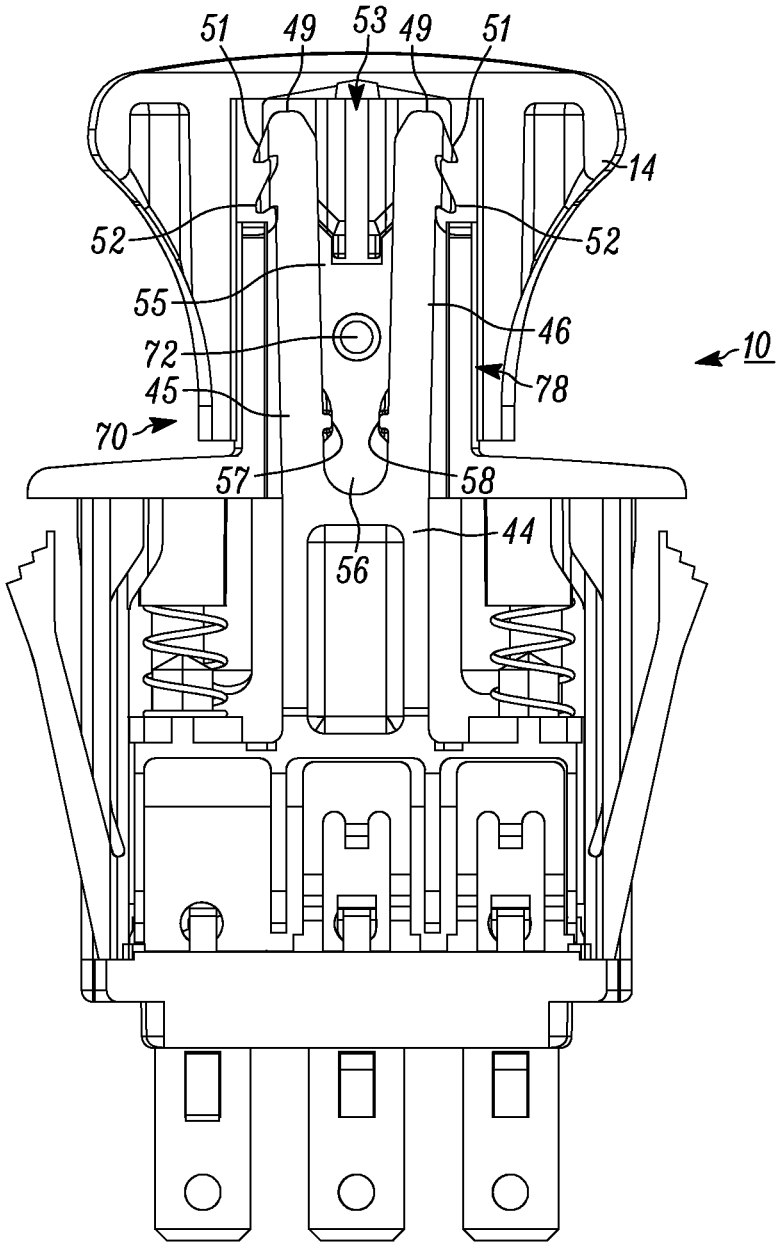
FIG. 13 is a front elevation view of FIG. 11.

The internal chamber 60 of the housing 40 includes an opening 62 for the translational passage of the shaft body 44 as a user of the lawn tractor 12 actuates the knob 14 from the first position (FIGS. 10 and 12) to the second position (FIGS. 11 and 13). The housing 40 further comprises a neck portion 64 that restrains the shaft body 44 during back and forth translation along an axis "X" (see FIG. 10) by the shaft body within the neck portion when the knob 14 is actuated by the user.

At least one spring 66 engages the housing 40 and the shaft body 44 to bias the shaft body into the housing. In the exemplary embodiment, posts 67 extending from a surface of contact region 48 of the shaft body 44 position two springs 66 and trap those springs between the shaft body and a corresponding sleeve 68 of the housing 40.

Figure 14:
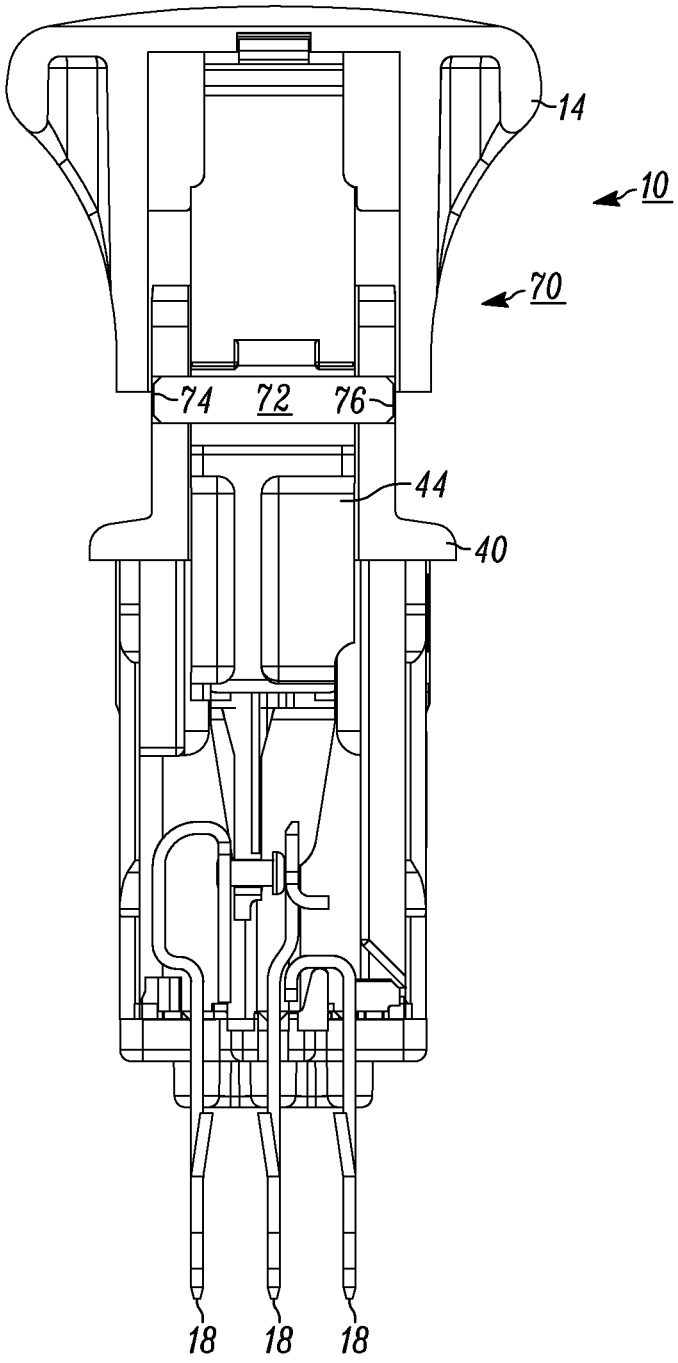
FIG. 14 is a side elevation view of FIG. 10.
Figure 15:
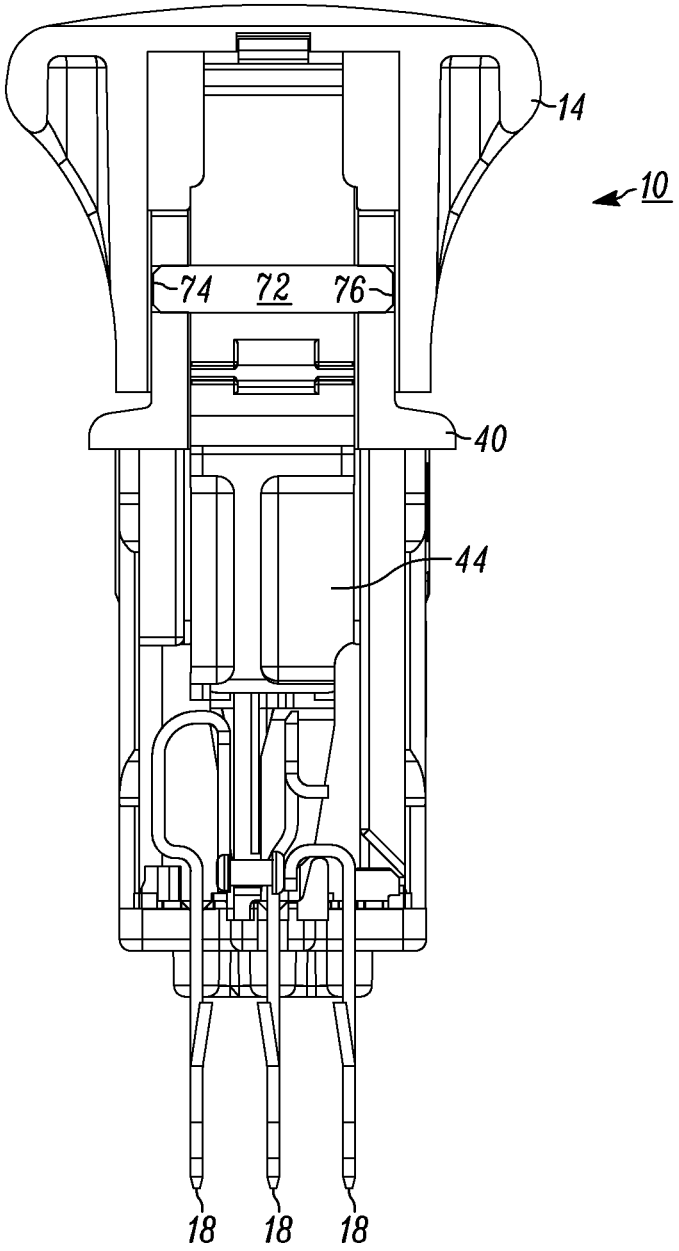
FIG. 15 is a side elevation view of FIG. 11.
Figure 16:
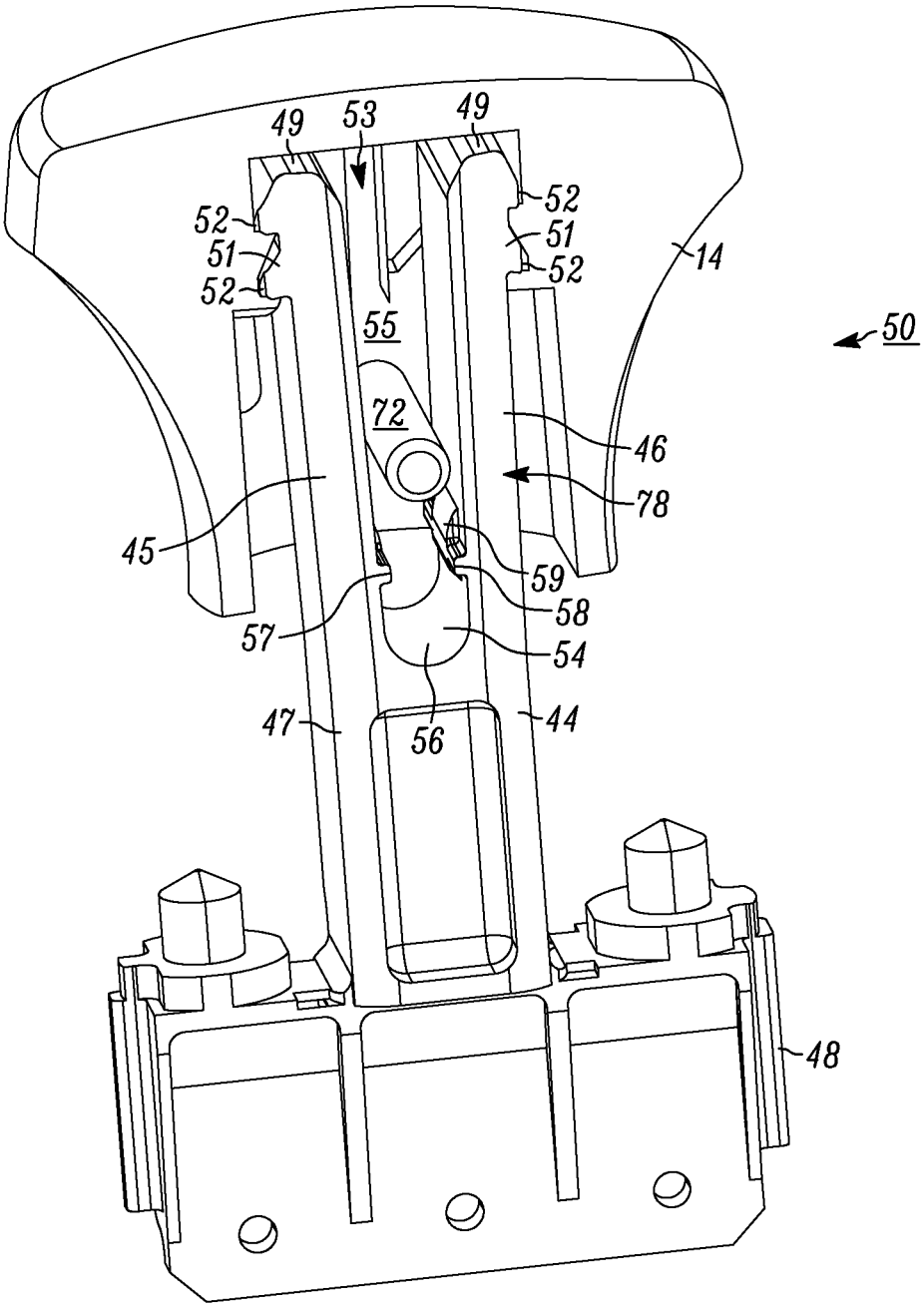
FIG. 16 is a connector assembly shown in a first position in accordance with one example embodiment of the present disclosure.
Figure 17:
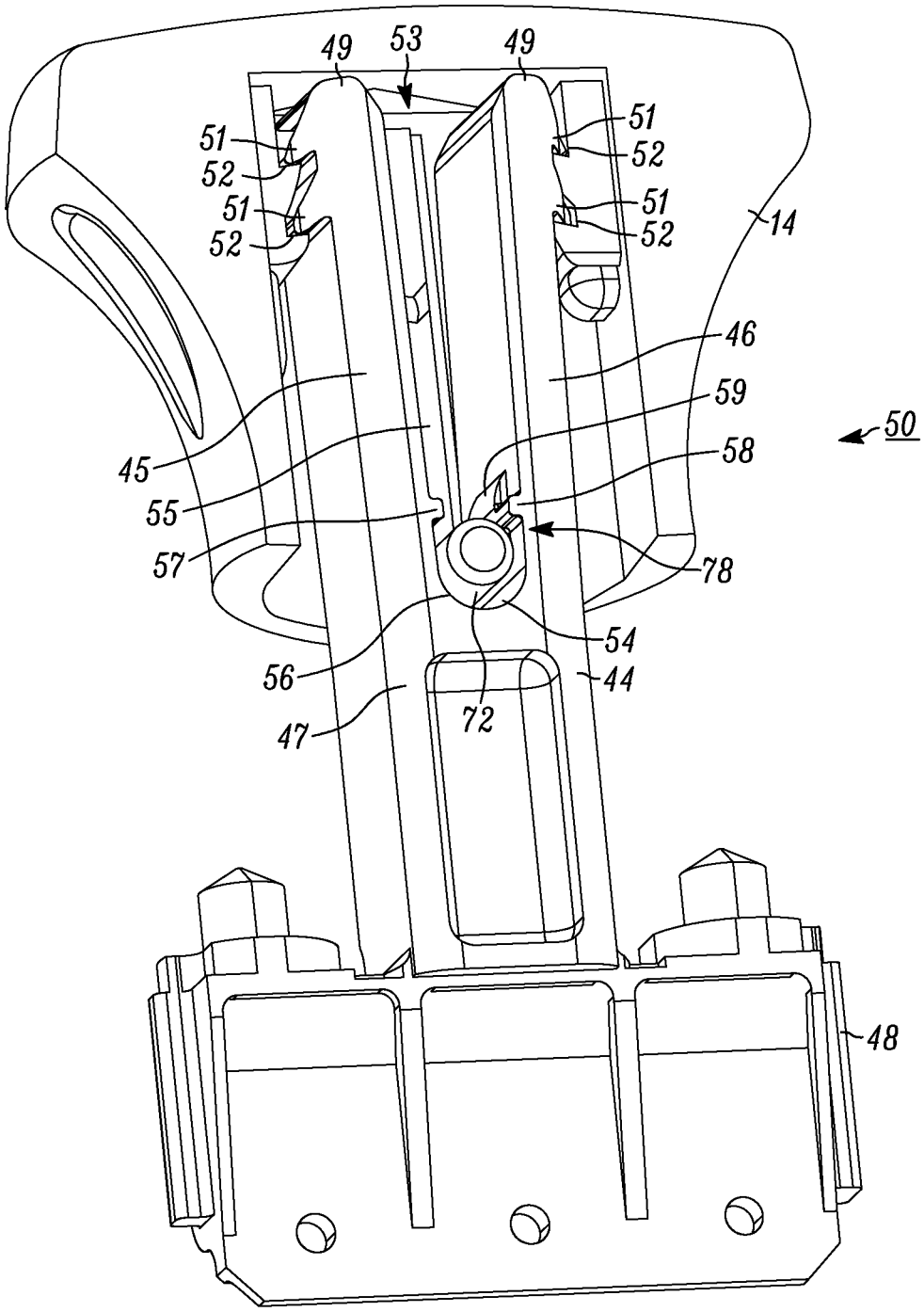
FIG. 17 is a connector assembly shown in a second position in accordance with one example embodiment of the present disclosure.
Figure 18:
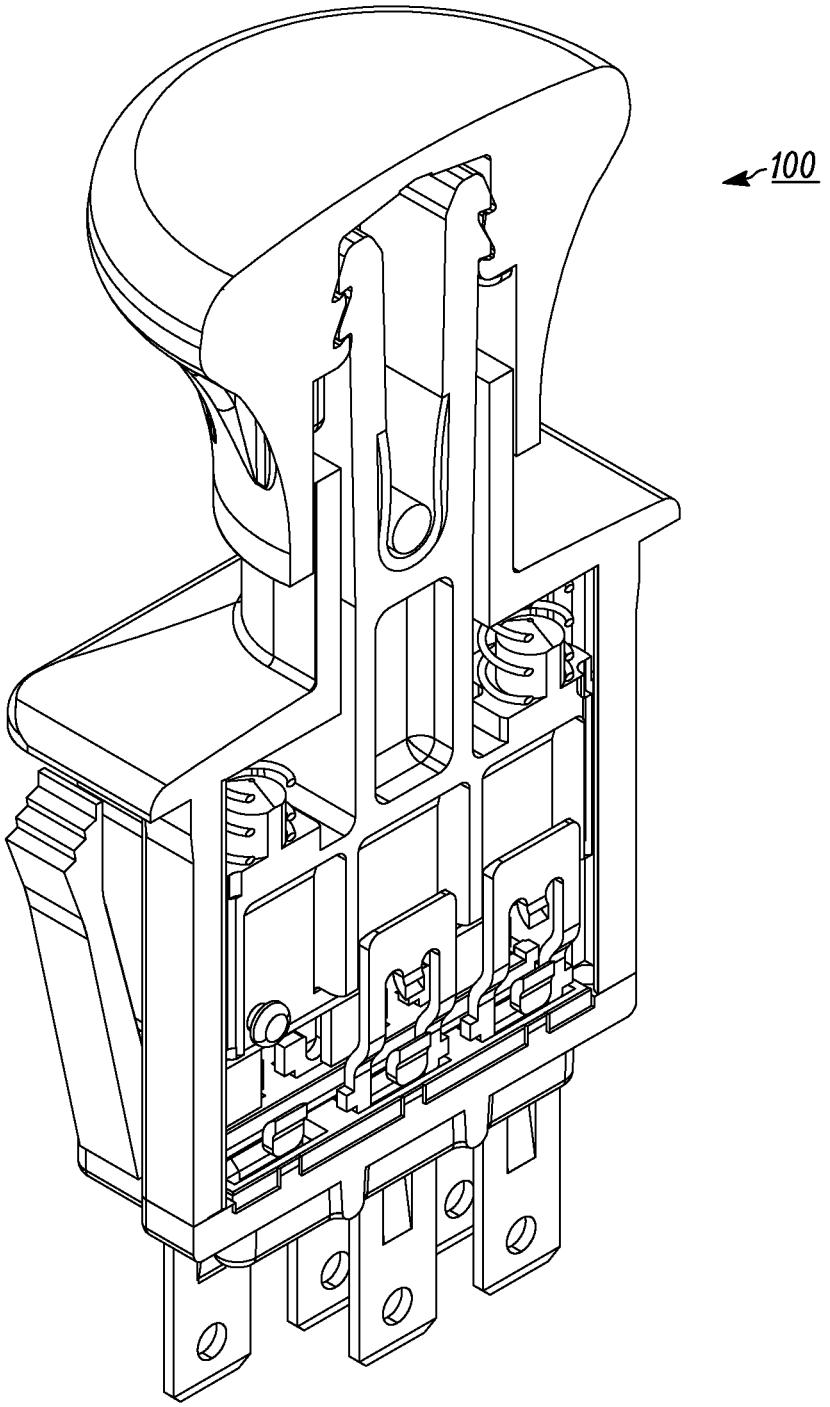
FIG. 18 is a perspective sectional view of a switch assembly in a first position constructed in accordance with another example embodiment of the present disclosure.

A securing arrangement 70 is formed between the connection assembly 50 and the housing 40. The securing arrangement 70 holds the switch assembly 10 in selectively first or second positions until the switch position is changed by the operator, eliminating the possibility for switch failure by voluntary movement between the first and second positions. The securing arrangement comprises a securing pin 72 press-fit within securing apertures 74, 76 formed within the housing 40 as best seen in FIGS. 14-15. In one example embodiment, the securing pin 72 is made from steel. In another example embodiment, the securing pin is made from a hardened plastic.

The securing arrangement 70 in addition to the securing pin 72 further comprises a securing region 78 of the shaft body 44 formed within the central channel 53. In particular, the securing region 78 comprises upper and lower portions 55, 56, respectively of the center channel 53 and first and second riser regions 57, 58.

The first and second riser regions 57, 58 are generally defined by protrusions extending into the central channel 53 by being formed or molded into legs 45, 46. In an alternative example embodiment, the riser regions 57, 58 further comprise a clip 59 positioned over each respective riser (see FIG. 17). In the illustrated example embodiment of FIG. 17, the clip is formed from metal.

The securing pin 72 is sized to move through the central channel 53 and engage risers 57, 58 as it passes from the first to second and second to first positions, nesting alternatively free from interference once in the first or second positions while residing in the upper or lower portions 55, 56. The risers 57, 58 create a high enough amount of interference with the securing pin 72 to prevent voluntary movement of the connection assembly 50 between first and second positions, while not so high that bending stresses on first and second legs 45, 46, are minimized within an elastic range capable of an infinite number of cycles without failure.

Advantageously, as the securing pin 72 passes through the risers 57, 58, the distal ends 49 of the first and second legs 45, 46 are deflected outward at a greater distance than the amount experienced at the securing pin, resulting in enhanced locking force between the barbs 51 in respective slots 52 of the knob 14. This enhanced locking force desirously provides a greater pull off force between the knob 14 and connection assembly 50. In one example embodiment, the securing pin diameter is 0.010" inches wider than the distance between the risers 57 and 58.

The securing arrangement 70 further advantageously is believed to require a higher pull force after a 1000 cycles. That is, switch arrangements of the prior art typically provide a pull force of approximately twelve (12 lbs.) pounds after the first couple cycles then dropping significantly by 70-75% to only three to four pounds through its product life. While the switch assembly 10 of the present disclosure is believed to provide a pull force of approximately twelve (12 lbs.) after the first couple cycles then desirably diminishing no less than twenty five 25% to approximately eight (8 lbs.) throughout the remainder of the switch product life.

Referring now to FIGS. 18-23 is a switch assembly 100 constructed in accordance with another example embodiment of the present disclosure. The switch assembly 100, in addition to those features illustrated in FIGS. 6-9, further comprises a connector assembly 150 (see FIGS. 22 and 23) formed from the knob 14 and shaft body 44. In one example embodiment, the knob 14 and shaft body 44 are made from plastic. In an alternative example embodiment, the shaft body 44 is made from a thermoplastic material with a surface lubricant impregnated into the plastic. The shaft body 44 comprises first and second legs, 45, 46, respectively, base member 47 and contact region 48. At a distal end 49 of the legs 45, 46, a plurality of barbs 51 are formed that nest in corresponding slots 52 formed within the knob 14.

The first and second legs 45, 46 are spaced by a central channel 53 that extends from the distal end 49 to a proximal end 54, contacting the shaft body 44. The central channel 53 includes an upper portion 55 and a lower portion 56. Located within the upper and lower portions 55, 56, is a recess 80 for receiving a securing housing 82.

The securing housing 82 is inserted into the recess 80 and forms a u-shaped member having first and second ends 83, 84 forming a valley 85 opposite and continuous between the ends. Located and opposingly spaced between the ends 83, 84 and valley 85 are concave walls 86, 87 that converge inward toward each other, having a smaller space between the walls in the u-shaped member than the spacing near the ends and valley. The securing housing 82 is press-fit into the recess 80 of the shaft body 44 and held into position by catches 90, 91 formed into the shaft body 44 that engage the ends 83, 84 of the securing housing.

In one example embodiment, the securing housing 82 is made from steel. In another example embodiment, the securing housing 82 is made from hardened steel, such as 4150 that has high wear resistant properties.

Referring now specifically to FIGS. 18-21, the shaft body 44 is positioned within an internal chamber 60 of the housing 40 (see FIG. 20) and the contact region 48 is a relatively planer with the base member 47. The contact region 48 positions a number of terminals 18 having conductive surfaces for biased engagement with selected switch contacts to form an electrical path between with terminal assembly via a wire harness (not shown).

Figure 19:
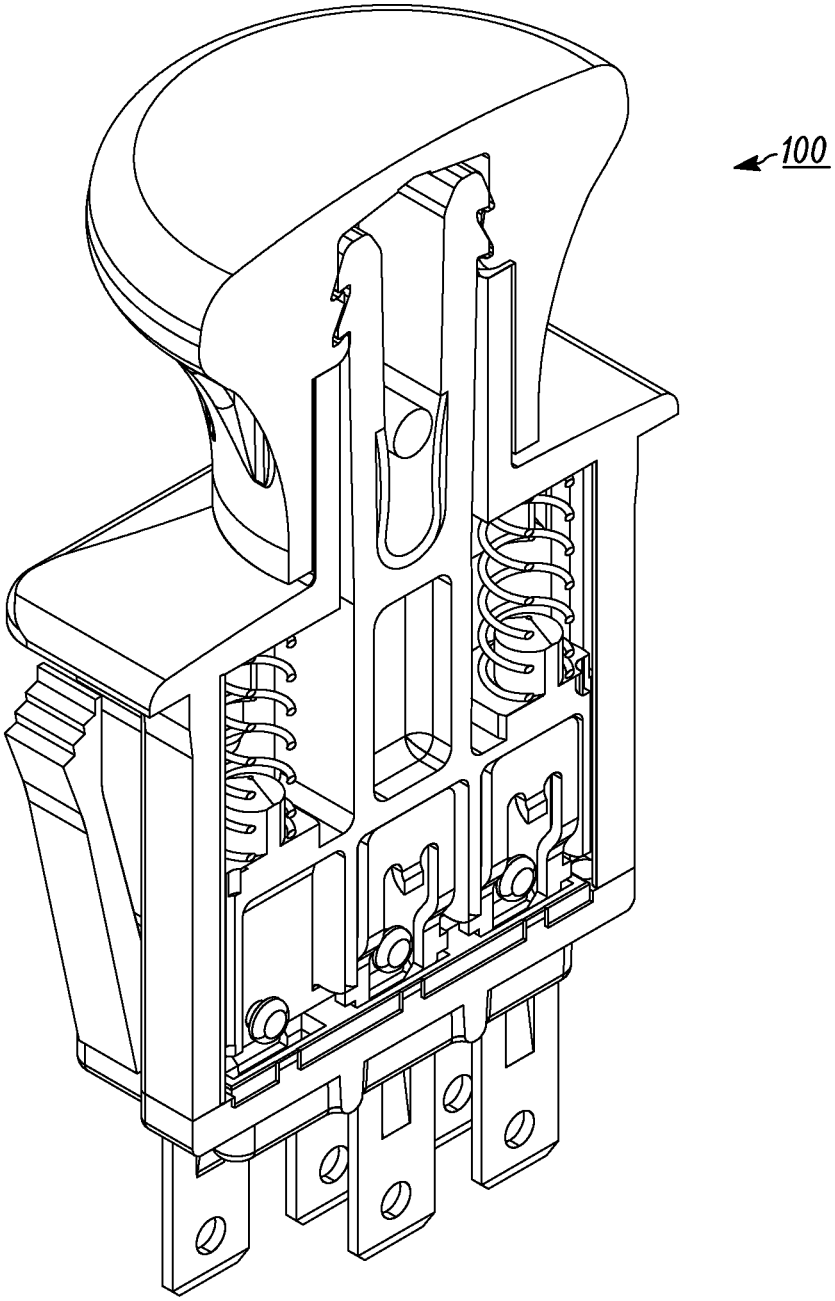
FIG. 19 is the switch assembly of FIG. 18 in a second position.
Figure 20:
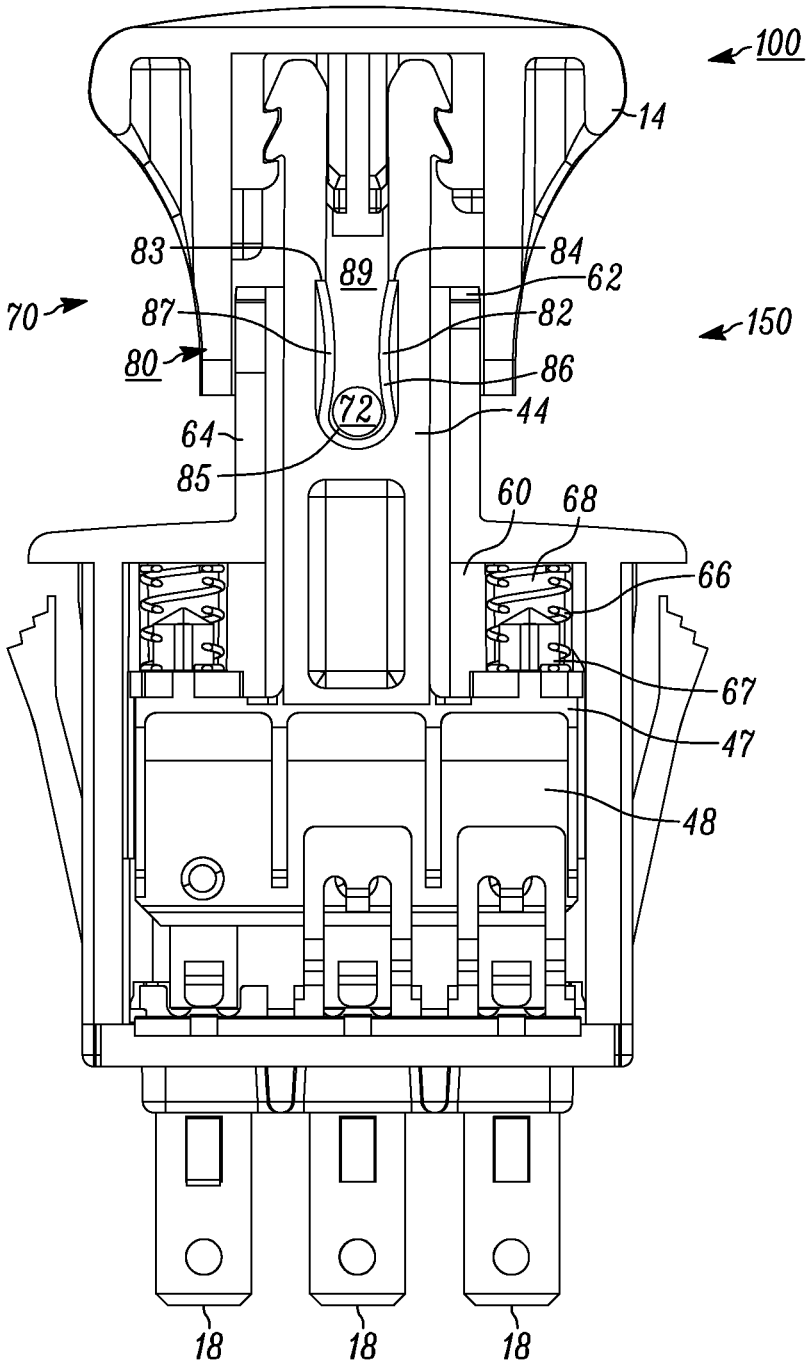
FIG. 20 is a front elevation view of FIG. 18.
Figure 21:
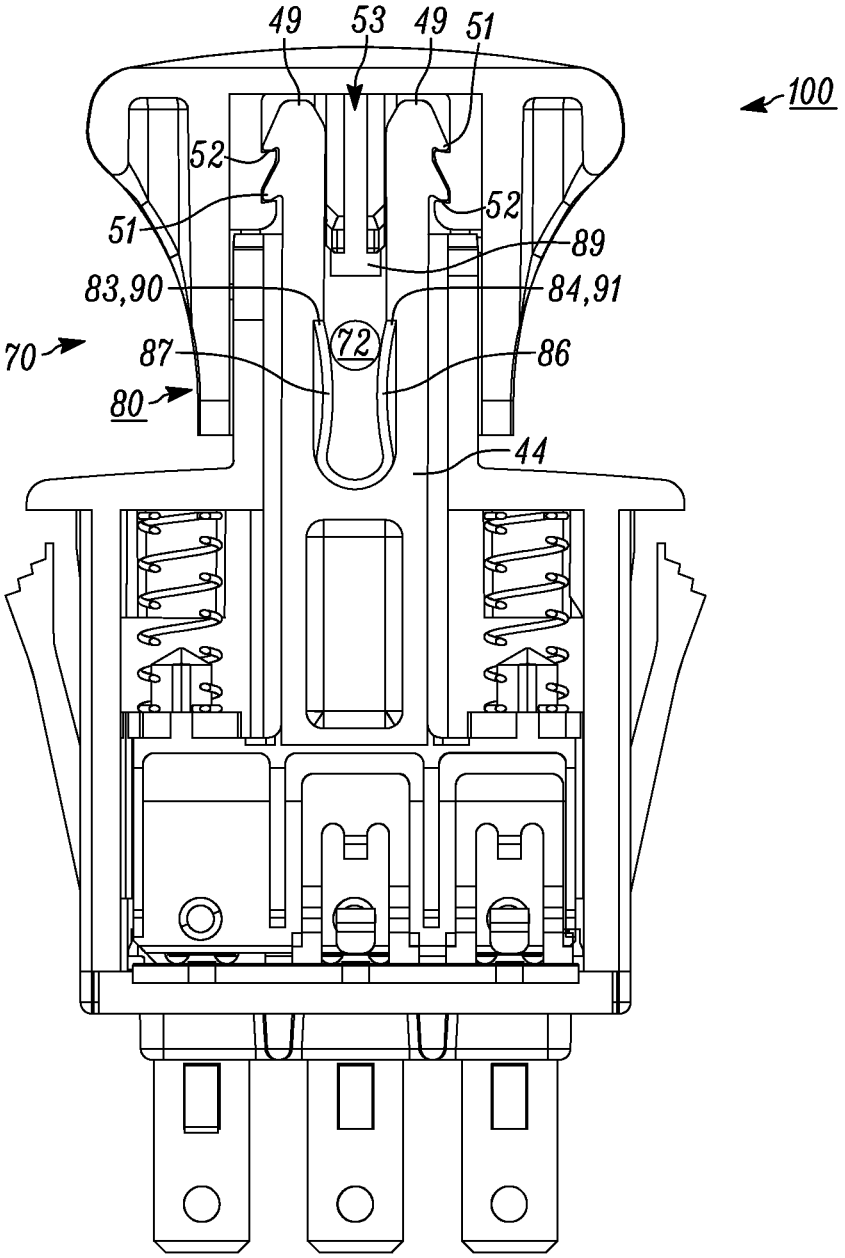
FIG. 21 is a front elevation view of FIG. 19.
Figure 22:
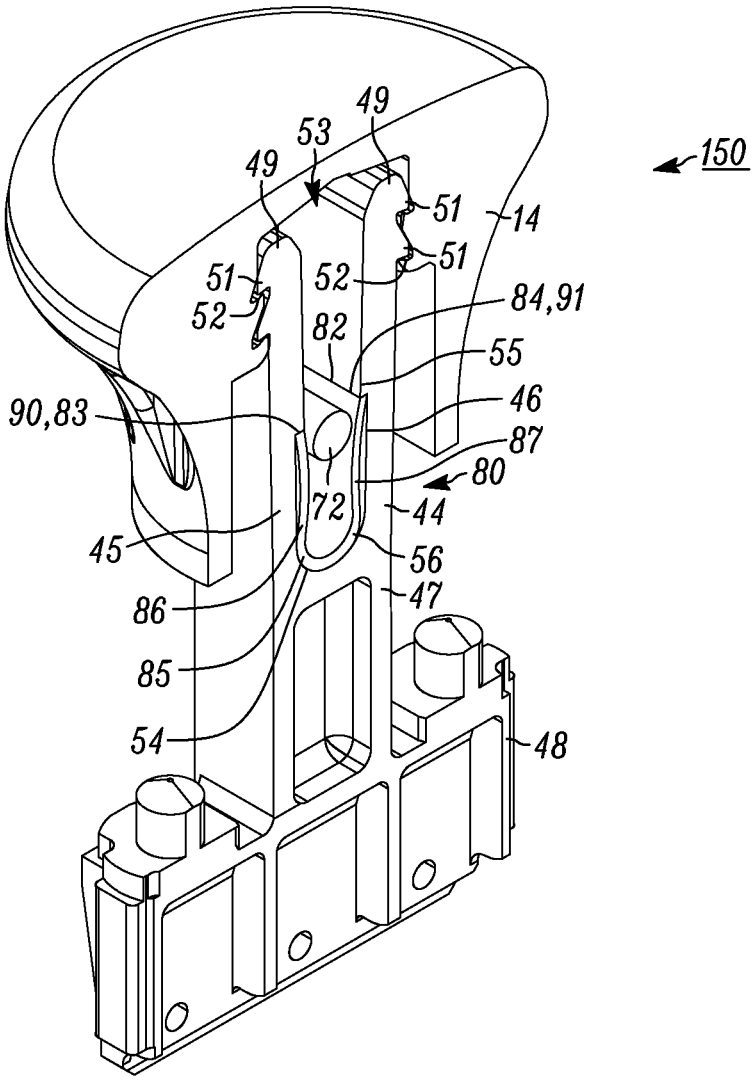
FIG. 22 is a connector assembly shown in a first position in accordance with one example embodiment of the present disclosure.
Figure 23:
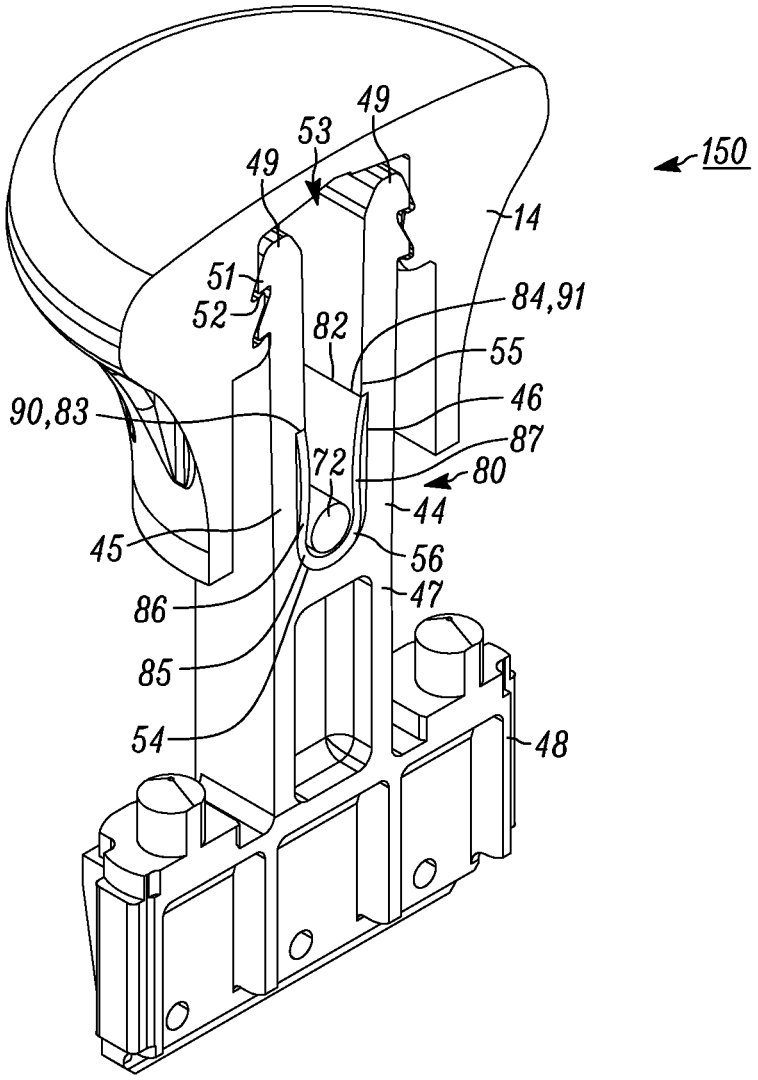
FIG. 23 is a connector assembly shown in a second position in accordance with one example embodiment of the present disclosure.

The internal chamber 60 of the housing 40 includes an opening 62 for the translational passage of the shaft body 44 as a user of the lawn tractor 12 actuates the knob 14 from the first position (FIGS. 18 and 20) to the second position (FIGS. 19 and 21). The housing 40 further comprises a neck portion 64 that restrains the shaft body 44 during back and forth translation along an axis "X" (see FIG. 20) by the shaft body within the neck portion when the knob 14 is actuated by the user.

At least one spring 66 engages the housing 40 and the shaft body 44 to bias the shaft body into the housing. In the exemplary embodiment, posts 67 extending from a surface of contact region 48 of the shaft body 44 position two springs 66 and trap those springs between the shaft body and a corresponding sleeve 68 of the housing 40.

A securing arrangement 70 is formed between the connection assembly 150 and the housing 40. The securing arrangement 70 holds the switch assembly 100 in selectively first or second positions until the switch position is changed by the operator, eliminating the possibility for switch failure by voluntary movement between the first and second positions. The securing arrangement 70 comprises a securing pin 72 press-fit within securing apertures 74, 76 formed within the housing 40. In one example embodiment, the securing pin 72 is made from steel. In another example embodiment, the securing pin is made from a hardened plastic.

The securing arrangement 70 in addition to the securing pin 72 further comprises the securing housing 82 located within the central channel 53 of the shaft body 44. The securing pin 72 is sized to move through the securing housing 82 into the central channel 53 and engage concave walls 86, 87 as it passes from the first to second and second to first positions, nesting alternatively free from interference once in the first or second positions while residing in the valley 85 or an end region 89 near first and second ends 83, 84. The concave walls 86, 87 create a high enough amount of interference with the securing pin 72 to prevent voluntary movement of the connection assembly 150 between first and second positions, while not so high that bending stresses on first and second legs 45, 46, are minimized within an elastic range capable of an infinite number of cycles without failure.

Advantageously, as the securing pin 72 passes through the concave walls 86, 87, the distal ends 49 of the first and second legs 45, 46 are deflected outward at a greater distance than the amount experienced at the securing pin, resulting in enhanced locking force between the barbs 51 in respective slots 52 of the knob 14. This enhanced locking force desirously provides a greater pull off force between the knob 14 and connection assembly 150. In one example embodiment, the securing pin diameter is 0.010" inches wider than the distance between the concave walls 86 and 87.

The securing arrangement 70 further advantageously is believed to require a higher pull force after a 1000 cycles. That is, switch arrangements of the prior art typically provide a pull force of approximately twelve (12 lbs.) pounds after the first couple cycles then dropping significantly by 70-75% to only three to four pounds through its product life. While the switch assembly 100 of the present disclosure is believed to provide a pull force of approximately twelve (12 lbs.) after the first couple cycles then desirably diminishing no less than twenty five 25% to approximately eight (8 lbs.) throughout the remainder of the switch product life.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

What is claimed is:

1. A switch apparatus comprising:

a housing having an interior chamber for supporting a portion of a shaft body, the shaft body having a portion extending from the housing coupled to a pull knob such that said shaft body and pull knob are selectively located from a first position to a second position;

the shaft body further comprising spaced first and second legs comprising a securing arrangement disposed within a channel formed by said legs, the securing arrangement comprising a restricted region formed about a portion of said legs in said channel and a securing pin fixedly attached to said housing, such that said securing pin engages said restricted region when said shaft body and pull knob transition from said first position to said second position.

2. The switch apparatus of claim 1 wherein said restricted region comprises first and second risers formed in opposing surfaces of said first and second legs.

3. The switch apparatus of claim 2 wherein said first and second risers further comprise a respective arcuate clip for selectively locating and holding said securing pin in one of said first and second positions.

4. The switch apparatus of claim 1 further comprising at least one terminal such that movement of said pull knob and shaft body relative to said housing from said first and second positions changes the state of an electrical signal transmitted from said at least one terminal.

5. The switch apparatus of claim 4 wherein said switch apparatus is an electromechanical switch for activating a power take off in a lawn tractor.

6. The switch apparatus of claim 1 wherein said shaft body is formed from molded plastic impregnated with a lubricant, facilitating selective movement of said securing pin between said first and second positions.

7. The switch apparatus of claim 1 wherein said securing pin comprises a cylindrical pin having a diameter that is greater than an opening formed in said restriction region that said securing pin passes as said pull knob and shaft body passes from said first position to said second position relative to said housing.

8. The switch assembly of claim 7 wherein said passage of said cylindrical diameter through said opening in said restriction region deflects said legs away from said restricted region, further locking distal ends of said legs into said pull knob.

9. The switch apparatus of claim 1 wherein said restricted region comprises a u-shaped securing housing having first and second opposingly faced concave walls.

10. The switch assembly of claim 9 wherein said u-shaped securing housing comprises an upper portion and a lower portion disposed about said restricted region and said securing pin comprising a cylindrical body, said upper and lower portions comprise an opening larger than the diameter of said cylinder body of said securing pin, allowing for said securing pin to next freely while in said upper or lower portion.

11. An electromechanical switch for operating a blade of a lawn tractor, the electromechanical switch comprising:

a housing having an interior chamber for supporting a portion of a shaft body, the shaft body having a portion extending from the housing coupled to a pull knob such that said shaft body and pull knob are selectively located from a first position to a second position relative to said housing;

the shaft body further comprising an upper end and a lower end, the upper end having spaced first and second legs comprising a securing arrangement disposed within a channel formed by said legs, the securing arrangement comprising a narrowing region formed about a portion of said legs in said channel, said lower end comprising at least one electrical contact that changes the state of an electrical signal transmitted from said at least one contact as said shaft body and pull knob are selectively located between said first position and said second position;

a cylindrical securing pin fixedly attached to said housing, such that said securing pin engages said narrowing region when said shaft body and pull knob transition between said first position and said second position.

12. The electromechanical switch of claim 11 wherein said channel is formed by planer surfaces between first and second legs that are substantially linear, forming a first opening, the channel extending forming a second opening at said narrowing region along said planer surfaces, the narrowing region comprising first and second risers formed in opposing portions of said planer surfaces of said first and second legs such that said first opening is greater than said second opening.

13. The electromechanical switch apparatus of claim 12 wherein said first and second risers further comprise a respective arcuate clip for selectively locating and holding said securing pin in one of said first and second positions.

14. The electromechanical switch of claim 11 wherein said channel is formed by planer surfaces between said first and second legs, said channel having a first opening comprising substantially linear planer surfaces of said first and second legs, said channel having a second opening at substantially nonlinear planer surfaces between said first and second legs defined by said narrowing region, such that said first opening is greater than said second opening.

15. The electromechanical switch of claim 14 wherein said second opening is less than said diameter of said cylindrical securing pin and said first opening is greater than said diameter of said cylindrical securing pin.

16. The electromechanical switch of claim 15 further comprising a third opening, the second opening located between said first and third openings, the three openings defined by the planer surfaces of said first and second legs, wherein said planer surfaces in said third opening are substantially linear.

17. The electromechanical switch of claim 16 wherein said third opening is greater than said second opening, the second opening increasing for the passage of said pin as said shaft body moves between said first and second positions positioning said securing pin into one of said first and third openings.

18. The electromechanical switch of claim 11 wherein said narrowing region comprises a u-shaped securing housing having first and second opposingly faced concave walls.

19. A method of actuating an electromechanical switch for operating a blade of a lawn tractor, the method comprising the steps of:

supporting a portion of a shaft body for movement within an interior chamber of a housing;

coupling an upper end of the shaft body to a pull knob, the pull knob selectively translates said shaft body between first and second positions relative to said housing;

forming a channel though said shaft body at said upper end defined by first and second legs, the channel selectively moveable by an operator during use about a securing pin coupled to said housing that passes through said channel;

attaching at least one electrical contact to a lower end of the shaft body for changing the state of an electrical signal transmitted from said at least one contact as said shaft body moves between said first and second positions; and forming a restrictive region within said channel for retaining said electromechanical switch in the selected first or second positions, the restrictive region having an opening smaller than the width of said securing pin such that said shaft body requires a force applied by the user during operation for selectively moving said securing pin through the restrictive region as the switch and shaft body passes between first and second positions.

20. The method of claim 19 wherein said force for an initial movement between said first and second positions is an initial force value and subsequent forces for movement between said first and second positions remains at least 75% of said initial force value.

* * * * *